US007465385B2

(12) United States Patent
Egli et al.

(10) Patent No.: US 7,465,385 B2
(45) Date of Patent: Dec. 16, 2008

(54) GOLD ALLOY ELECTROLYTES

(75) Inventors: André Egli, Reussbuehl (CH); Wing Kwong Wong, Tuen Mun (HK); Raymund W. M. Kwok, Kowloon (HK); Jochen Heber, Neuenbuerg (DE)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 320 days.

(21) Appl. No.: 11/445,617

(22) Filed: Jun. 2, 2006

(65) Prior Publication Data

US 2006/0283714 A1 Dec. 21, 2006

Related U.S. Application Data

(60) Provisional application No. 60/686,774, filed on Jun. 2, 2005.

(51) Int. Cl.
*C25D 3/58* (2006.01)
*C25D 5/18* (2006.01)
*C23C 16/00* (2006.01)

(52) U.S. Cl. ..... 205/242; 106/1.26; 205/102; 205/104

(58) Field of Classification Search ..... 106/1.26; 427/437; 205/102, 104, 242
See application file for complete search history.

(56) References Cited

U.S. PATENT DOCUMENTS

| | | | | |
|---|---|---|---|---|
| 3,380,814 | A | 4/1968 | Cathrein et al. | |
| 3,380,898 | A | 4/1968 | Danemark et al. | |
| 3,637,393 | A | 1/1972 | Sakamoto et al. | |
| 3,642,589 | A | 2/1972 | Nobel et al. | |
| 3,902,977 | A | 9/1975 | Greenspan | 204/43 G |
| 3,915,814 | A | 10/1975 | Greenspan | |
| 4,364,804 | A | 12/1982 | Aliprandini | |
| 4,394,511 | A | 7/1983 | Sawa et al. | |
| 4,431,818 | A | 2/1984 | Sawa et al. | |
| 4,455,262 | A | 6/1984 | Detienne et al. | |
| 4,465,564 | A | 8/1984 | Fletcher et al. | |
| 4,469,622 | A | 9/1984 | Sawa et al. | |
| 4,555,578 | A | 11/1985 | Nagata et al. | |
| 4,590,014 | A | 5/1986 | Wolf et al. | |
| 4,632,741 | A | 12/1986 | Wolf et al. | |
| 4,869,971 | A | 9/1989 | Nee et al. | |
| 5,006,208 | A | 4/1991 | Kuhn et al. | |
| 5,085,744 | A | 2/1992 | Brasch | |
| 5,256,275 | A | 10/1993 | Brasch | |
| 6,099,713 | A | 8/2000 | Yanada et al. | 205/253 |
| 6,508,927 | B2 | 1/2003 | Yanada et al. | 205/241 |
| 6,645,364 | B2 * | 11/2003 | Calvert et al. | 205/81 |
| 6,824,597 | B2 | 11/2004 | Heber et al. | |
| 2003/0070934 | A1 | 4/2003 | Cobley et al. | 205/263 |

FOREIGN PATENT DOCUMENTS

| | | |
|---|---|---|
| DE | 1 923 786 | 11/1969 |
| EP | 0 119 424 | 5/1987 |
| EP | 0 198 998 | 6/1988 |
| EP | 0 126 921 | 1/1989 |
| EP | 0 304 315 | 3/1993 |
| FR | 2.053.770 | 4/1971 |
| GB | 1244095 | 8/1971 |

OTHER PUBLICATIONS

Cretu et al.; "Coloured Gold Alloys"; Mintek, Randburg, S. Afr.; Gold Bulletin (London); 1999; 32(4), pp. 31-40, no month.
Australian Search Report of corresponding Singapore Application No. 200603606.5, Feb. 12, 2007.
Patent Abstract of Japan; JP 2003171789A (Ishihara Chemical Co. Ltd.) Jun. 20, 2003.

* cited by examiner

*Primary Examiner*—Edna Wong
(74) *Attorney, Agent, or Firm*—John J. Piskorski

(57) ABSTRACT

Compositions and methods for depositing gold alloys are disclosed. The compositions include certain dithiocarboxylic acids, salts and esters thereof and mercapto group containing compounds which provide bright gold alloy deposits with uniform color.

8 Claims, No Drawings

GOLD ALLOY ELECTROLYTES

The present invention is directed to improved electrolytes for depositing gold alloys. More specifically, the present invention is directed to improved electrolytes for depositing gold alloys which include certain combinations of sulfur containing organic compounds to provide the gold alloy deposits with improved brightness and color uniformity.

Gold alloys have been deposited for many years onto watchcases, watchbands, eyeglass frames, writing instruments, jewelry in general as well as various other articles. For example, the most often utilized electroplated gold alloy for these applications has been gold-copper-cadmium. Since cadmium is such a poisonous metal, however, the electroplating industry has been searching for a substitute having a reduced level of toxicity. In addition to being non-toxic, the gold alloy deposits produced with such a cadmium substitute must have the following physical characteristics:

1. The deposits must have the correct color, as required. Usually, these colors are Swiss standard "1-5N", which range from specific pale yellow to pink gold alloys, with the "2N" yellow grade being preferred.
2. The deposits must be bright such that no further polishing is required after plating. This degree of brightness must be maintained even for thick deposits as high as 20 microns.
3. The plating bath must produce deposits that exhibit leveling such that tiny imperfections in the basis metal are smoothed out or covered.
4. The karat of the deposits should be required. These karats generally range from 12 to 18, or 50-75% gold.
5. All deposits must be reasonably ductile and capable of passing the required ductility tests, even with thicknesses as high as 20 microns.
6. The deposits should be corrosion resistant and capable of passing the required corrosion tests.

A number of attempts have been made in the past to deposit cadmium-free alloys in a manner which can readily meet all of the above requirements. However, none have resulted in a commercially acceptable plating bath capable of producing deposits with the desired characteristics set forth above. The toxicity of cadmium metal has initiated legislative action by many jurisdictions to eliminate its use in many industries. Accordingly, it is highly desirable for industries to find a substitute for gold alloys containing cadmium.

U.S. Pat. No. 5,256,275 discloses a gold alloy electrolyte which eliminates cadmium. The gold alloy includes gold, silver and copper. In addition to the water soluble gold, silver and copper salts, the electrolyte from which the alloy is electroplated may include various organic sulfur compounds such as thiourea, thiobarbituric acid, imidazolidinethione, thiomalic acid, sodium thiosulfate, sodium thiocyanate and sodium isothiocyanate. The gold-silver-copper alloy addresses some of the desired characteristics described above. It often provides a brighter deposit than gold alloys with cadmium at equivalent thicknesses and karat. Although the gold alloy of the '275 patent is an improvement over the cadmium containing gold alloys, there is still a need to find a cadmium free gold alloy electrolyte which provides deposits having improved brightness and color uniformity at acceptable plating rates.

Compositions include one or more sources of gold ions, one or more sources of silver ions, one or more sources of copper ions, one or more compounds chosen from mercapto-tetrazoles and mercapto-triazoles and salts thereof, and one or more dithiocarboxylic acids having a non-protic carbon atom in alpha position to a dithiocarboxyl functionality, salts and esters thereof. In addition to the metal salts and the sulfur containing organic compounds, the compositions also may include additives for stabilizing the compositions and assisting in the formation of a gold alloy deposit on a substrate. The gold alloys are cadmium free alloys.

In another embodiment, compositions include essentially one or more sources of gold ions, one or more sources of silver ions, one or more sources of copper ions, one or more dithiocarboxylic acids having a non-protic carbon atom in alpha position to a dithiocaboxyl functionality, salts and esters thereof, one or more surfactants, one or more alkaline materials, and one or more compounds selected from the group consisting of mercapto-tetrazoles, mercapto-triazoles and salts thereof.

In a further embodiment a method includes providing a composition including one or more sources of gold ions, one or more sources of silver ions, one or more sources of copper ions, one or more compounds chosen from mercapto-tetrazoles, mercapto-triazoles and salts thereof, and one or more dithiocarboxylic acids having a non-protic carbon atom in alpha position to a dithiocarboxyl functionality, salts and esters thereof; placing a substrate in the composition; and depositing a gold alloy on the substrate.

In a further embodiment articles deposited with the gold alloy compositions and by the methods are provided. The articles include gold alloy deposits of 8 to 23 karats and a 2N color or a 3N color, which is a desired yellow to deep yellow grade. Such articles include jewelry and other decorative articles.

As used throughout this specification, the following abbreviations shall have the following meanings, unless the context clearly indicates otherwise: ° C.=degrees Centigrade; g=gram; mg=milligrams; L=liter; mL=milliliters; μm=microns=micrometers; ASD=amperes/decimeter squared=A/dm$^2$; DC=direct current; and ms=milliseconds.

The terms "depositing" and "plating" are used interchangeably throughout this specification. "Alkyl" refers to linear, branched and cyclic alkyl. "Halide" refers to fluoride, chloride, bromide and iodide. Likewise, "halo" refers to fluoro, chloro, bromo and iodo. Unless otherwise indicated, aromatic compounds having two or more substituents include ortho-, meta- and para-substitution. The term "karat"="carat" and is the unit of gold fineness which indicates the percentage of gold in an article, e.g., 24 karat=100% gold and 18 karat=75% gold or also expressed as 750 0/00. "N" represents the Swiss watch industry standard for representing gold colors, i.e., 1N=greenish-gold, 2N=yellow gold, 3N=deep yellow gold, 4N=pinkish-gold, and 5N=yellow-red gold.

All percentages are by weight, unless otherwise noted. All numerical ranges are inclusive and combinable in any order, except where it is logical that such numerical ranges are constrained to add up to 100%.

The compositions include one or more sources of gold ions, one or more sources of silver ions, one or more sources of copper ions, one or more compounds chosen from mercapto-tetrazoles and mercapto-triazoles and salts thereof, and one or more dithiocarboxylic acids having a non-protic carbon atom in alpha (α) position to a dithiocarboxyl functionality (—C(S)SX), salts and ester thereof, where X is hydrogen or a suitable counter-ion. The electrolyte compositions also may include additives to stabilize the compositions and assist in depositing bright and uniformly colored gold alloys on substrates.

Any suitable source of gold ions which are water soluble may be used. Such compounds provide gold (I) to the compositions. Such sources of gold ions include, but are not limited to, alkali gold cyanide compounds such as potassium gold cyanide, sodium gold cyanide, and ammonium gold cyanide, alkali gold thiosulfate compounds such as trisodium gold thiosulfate and tripotassium gold thiosulfate, alkali gold sulfite compounds such as sodium gold sulfite and potassium gold sulfite, ammonium gold sulfite, and gold(I)halides such as gold(I)chloride. Typically, the alkali gold cyanide compounds are used such as potassium gold cyanide.

The amount of the one or more water soluble gold compounds is from 0.5 g/L to 15 g/L, or such as from 2 g/L to 12 g/L, or such as from 5 g/L to 10 g/L. Such water soluble gold compounds are generally commercially available from a variety of suppliers or may be prepared by methods well known in the art.

Optionally, a wide variety of gold complexing agents may be included in the compositions. Suitable gold complexing agents include, but are not limited to, alkali metal cyanides such as potassium cyanide, sodium cyanide and ammonium cyanide, thiosulfuric acid, thiosulfate salts such as sodium thiosulfate, potassium thiosulfate, and ammonium thiosulfate, ethylenediamine tetraacetic acid and its salts, and nitrilotriacetic acid. Typically the alkali metal cyanides are used.

The one or more complexing agents may be added in conventional amounts, or such as in amounts of 0.5 g/L to 50 g/L, or such as 5 g/L to 25 g/L, or such as 10 g/L to 20 g/L. The one or more complexing agents are generally commercially available or may be prepared from methods well known in the art.

Any of a wide variety of water soluble silver compounds that provide silver ions to the compositions may be used. Suitable silver compounds include, but are not limited to, alkali silver cyanide compounds such as potassium silver cyanide, sodium silver cyanide, and ammonium silver cyanide, silver halides such as silver chloride, and nitrates such as silver nitrate. Typically, the alkali silver cyanide compounds are used.

The amount of the one or more water soluble silver compounds is from 10 mg/L to 1000 mg/L, or such as from 50 mg/L to 500 mg/L, or such as from 100 mg/L to 250 mg/L. Such silver compounds are generally commercially available or may be prepared by methods well known in the art.

Any of a wide variety of water soluble copper compounds that provide copper to the compositions may be used. Suitable copper compounds include, but are not limited to, copper (I) cyanide, copper (I) and (II) chloride, copper (II) sulfate pentahydrate, copper (II) hydroxide. Typically copper (I) cyanide is used.

The total amount of the one or more water soluble copper compounds is from 1 g/L to 150 g/L, or such as from 10 g/L to 75 g/L, or such as from 20 g/L to 50 g/L. Such copper compounds are generally commercially available or may be prepared by methods well known in the art.

The organic sulfur containing compounds used are chosen from one or more mercapto-tetrazoles or salts thereof, or one or more mercapto-triazoles or salts thereof, or mixtures of mercapto-tetrazoles and mercapto-triazoles or salts thereof in combination with one or more dithiocarboxylic acids having a non-protic carbon atom in alpha position to the dithiocarboxyl functionality, salts and esters thereof. While not being bound by theory, it is believed that the one or more dithiocarboxylic acids, salts and esters thereof in combination with one or more of the mercapto-tetrazoles and mercapto-triazoles and their respective salts provide an improved brightness and color uniformity on the gold-silver-copper alloy deposits.

Any suitable dithiocarboxylic acid having a non-protic carbon atom in alpha position to the dithiocarboxyl functionality, salts and esters thereof which, in combination with the mercapto-tetrazoles and the mercapto-triazoles, provides the desired gold-silver-copper alloy brightness and color uniformity may be used in the compositions. Such suitable dithiocarboxylic acids having a non-protic carbon alpha to a dithiocarboxyl acid functionality include, but are not limited to, compounds such as imidazole 4(5)-dithiocarboxylic acids and their salts having a formula:

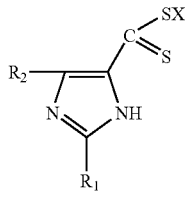

(I)

wherein $R_1$ is a hydrogen, straight or branched, saturated or unsaturated, substituted or unsubstituted ($C_1$-$C_{20}$) hydrocarbon group, or phenyl group; $R_2$ is hydrogen, or straight, branched, saturated or unsaturated, substituted or unsubstituted ($C_1$-$C_4$) hydrocarbon group; and X is a hydrogen, or a suitable counter-ion including, but not limited to, alkali metals such as sodium, potassium and lithium. Examples of $R_1$ hydrocarbon groups are methyl, ethyl, undecyl, and heptadecyl. Typically, $R_1$ is methyl, ethyl or phenyl. More typically $R_1$ is methyl or ethyl. Most typically, $R_1$ is methyl. Examples of $R_2$ are methyl and ethyl. Typically $R_2$ is methyl. Substituent groups include, but are not limited to, hydroxyl, alkoxy, carboxyl, amino, and halogen such as chlorine and bromine. The acid is formed when X is hydrogen, and the salt is formed when X is a counter-ion such as an alkali metal such as sodium, potassium and lithium.

Examples of acids covered by formula (I) are: imidazole-4(5)-dithiocarboxylic acid, 2-methylimidazole-4(5)-dithiocarboxylic acid, 2-ethylimidazole-4(5)-dithiocarboxylic acid, 2-undecylimidazole-4(5)-dithiocarboxylic acid, 2-heptadecylimidazole-4(5)-dithiocarboxylic acid, 2-phenylimidazole-4(5)-dithiocarboxylic acid, 4-methylimidazole-5-dithiocarboxylic acid, 2,4-dimethylimidazole-5-dithiocarboxylic acid, 2-ethyl-4-methylimidazole-5-dithiocarboxylic acid, 2-undecyl-4-methylimidazole-5-dithiocarboxylic acid, and 2-phenyl-4-methylimidazole-5-dithiocarboxylic acid.

Examples of salts covered by formula (I) are: sodium imidazole-4(5)-dithiocarboxylate, sodium 2-methylimidazole-4(5)-dithiocarboxylate, sodium 2-ethylimidazole-4(5)-dithiocarboxylate, sodium 2-undecylimidazole-4(5)-dithiocarboxylate, sodium 2-heptadecylimidazole-4(5)-dithiocarboxylate, sodium 2-phenylimidazole-4(5)-dithiocarboxylate, sodium 4-methylimidazole-5-dithiocarboxylate, sodium 2,4-diemthyl-5-dithiocarboxylate, potassium 2-ethyl-4-emthylimidazole-5-dithiocarboxylate, sodium 2-undecyl-4-methylimidazole-5-dithiocarboxylate, and sodium 2-phenyl-4-methylimidazole-5-dithiocarboxylate.

Other suitable dithiocarboxylic acids having a non-protic carbon atom alpha to a dithiocarboxy functionality include, but are not limited to, compounds such as S-(thiobenzoyl) thioglycolic acid and imidazole-dithiocarboxylic acid epichloro-hydrine polycondensate.

In general one or more of the dithiocarboxylic acids, salts and esters thereof may be used in the compositions in amounts of 0.5 mg/L to 500 mg/L, or such as from 10 mg/L to 250 mg/L, or such as from 50 mg/L to 150 mg/L. Such dithiocarboxylic acids, salts and esters thereof are generally commercially available or may be prepared by methods well known in the art. Examples of methods for making the imidazole 4(5)-dithiocarboxylic acids and their salts are disclosed in U.S. Pat. No. 4,394,511, U.S. Pat. No. 4,431,818, and U.S. Pat. No. 4,469,622.

Any suitable mercapto-tetrazole and salts thereof which provides the desired brightness and color uniformity of the gold-silver-copper alloy in combination with one or more of the dithiocarboxylic acids having a non-protic carbon alpha to a dithiocarboxyl functionality, salts and esters thereof may be used in the compositions. Such mercapto-tetrazoles also include mesoionic compounds such as tetrazolium compounds.

Examples of suitable mercapto-tetrazoles have a formula:

(II)

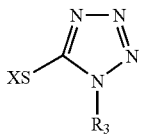

wherein $R_3$ is hydrogen, straight or branched, saturated or unsaturated ($C_1$-$C_{20}$) hydrocarbon group, ($C_8$-$C_{20}$)aralkyl, substituted or unsubstituted phenyl or naphthyl group, A-$SO_3$Y or A-COOY, where A is ($C_1$-$C_4$)alkyl, such as methyl, ethyl and butyl, and Y is hydrogen or a suitable counter-ion such as alkali metals such as sodium, potassium and lithium, or calcium or ammonium; and X is hydrogen, or a suitable counter-ion including, but not limited to, alkali metals such as sodium, potassium and lithium. Substituent groups on the phenyl and naphtyl include, but are not limited to, branched or unbranched ($C_1$-$C_{12}$)alkyl, branched or unbranched ($C_2$-$C_{20}$)alkylene, branched or unbranched ($C_1$-$C_{12}$)alkoxy, hydroxyl, and halogens such as chlorine and bromine.

Typically, $R_3$ is hydrogen, straight chain ($C_1$-$C_4$)alkyl, A-$SO_3$Y or A-COOY where Y is sodium ($Na^+$), and X is hydrogen, sodium, or potassium. More typically, $R_3$ is hydrogen or A-$SO_3$Na, and X is hydrogen. Most typically, $R_3$ is A-$SO_3$Na and X is hydrogen.

Examples of such acids include 5-mercapto-1H-tetrazole-1-acetic acid, 5-mercapto-1H-tetrazole-1-propionic acid, and 5-mercapto-1H-tetrazole-1-butyric acid, and salts thereof. Also included are the 5-mercapto-1H-tetrazole-1-alkane sulfonic acids and the mercapto-tetrazole sulfonic acids.

Examples of mesoionic compounds such as tetrazolium compounds which may be used in the electrolyte compositions have a formula:

(III)

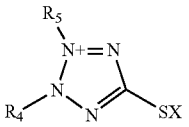

wherein X is defined as above; $R_4$ is a substituted or unsubstituted alkyl, alkenyl, thioalkoxy, or alkoxycarbonyl group having from 1 to 28 carbon atoms; a substituted or unsubstituted cycloalkyl group having from 3 to 28 carbon atoms; a substituted or unsubstituted aryl group having from 6 to 33 carbon atoms; a substituted or unsubstituted heterocyclic ring having from 1 to 28 carbon atoms and one or more hetero atoms such as nitrogen, oxygen, sulfur, or combinations thereof; an alkyl, cycloalkyl, alkenyl, alkoxyalkyl, aryl or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 28 carbon atoms and one or more heteroatoms such as nitrogen, oxygen, sulfur, or combinations thereof; and $R_5$ is a substituted or unsubstituted amine group having from 0 to 25 carbon atoms, typically 1 to 8 carbon atoms; a substituted of unsubstituted alkyl, alkenyl, or alkoxy group having from 1 to 28 carbon atoms; a substituted or unsubstituted cycloalkyl group from 3 to 28 carbon atoms; a substituted or unsubstituted acyloxy group having from 2 to 25 carbon atoms; a substituted or unsubstituted aryl group having from 6 to 33 carbon atoms; a substituted or unsubstituted heterocyclic ring having from 1 to 28 carbon atoms and one or more hetero atoms, such as nitrogen, oxygen, sulfur or combinations thereof; an alkyl, cycloalkyl, alkenyl, alkoxyalkyl, aryl, or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 25 carbon atoms and one or more hetero atoms such as nitrogen, oxygen, sulfur or combinations thereof.

In general, the mercapto-tetrazoles, including the tetrazolium compounds, are included in the electrolyte compositions in amounts of 0.5 mg/L to 200 mg/L, or such as from 10 mg/L to 150 mg/L, or such as from 50 mg/L to 100 mg/L. Such mercapto-tetrazoles are generally commercially available or may be prepared by methods well known in the art.

Any suitable mercapto-triazole compound and salts thereof which provide the desired brightness and color uniformity of gold-silver-copper alloys in combination with one or more dithiocarboxylic acids having a non-protic carbon alpha to a dithiocarboxyl functionality, salts and esters thereof may be used in the compositions. Mercapto-triazoles also include mesoionic compounds such as 1,2,4-triazoles.

Examples of suitable mercapto-triazoles have a formula:

(IV)

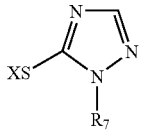

wherein $R_7$ is hydrogen, straight or branched, saturated or unsaturated ($C_1$-$C_{20}$) hydrocarbon group, ($C_8$-$C_{20}$)aralkyl, substituted or unsubstituted phenyl or naphthyl group; and X is hydrogen, or a suitable counter-ion including, but not limited to, alkali metals such as sodium, potassium and lithium. Substitutent groups on the phenyl and naphthyl include, but are not limited to, branched or unbranched ($C_1$-$C_{12}$)alkyl, branched or unbranched ($C_2$-$C_{20}$)alkylene, branched or unbranched ($C_1$-$C_{12}$)alkoxy, hydroxyl, and halogens such as chlorine and bromine. Typically, $R_7$ is hydrogen, straight chain ($C_1$-$C_4$) alkyl, and X is hydrogen, sodium or potassium. More typically, $R_7$ is hydrogen, methyl or ethyl, and X is hydrogen or sodium. Most typically, $R_7$ is hydrogen or methyl, and X is hydrogen.

Examples of mesoioinic compounds such as the triazolium compounds which may be used in the electrolyte compositions have a formula:

(V)

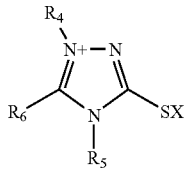

wherein $R_4$, $R_5$ and X are defined as above as for the mesoionic 1,2,4-triazoles; and $R_6$ is a substituted or unsubstituted amine group having from 0 to 25 carbon atoms of such as from 1 to 8 carbon atoms; a substituted or unsubstituted alkyl, alkoxy, or alkenyl group having from 1 to 28 carbon atoms; a substituted or unsubstituted cycloalkyl group having from 3 to 28 carbon atoms; a substituted or unsubstituted acyloxy group having from 2 to 25 carbon atoms; a substituted or unsubstituted aryl group having from 6 to 33 carbon atoms; a substituted or unsubstituted heterocyclic ring having from 1 to 28 carbon atoms and one or more hetero atoms, such as nitrogen, oxygen, sulfur or combinations thereof; an alkyl, cycloalkyl, alkenyl, alkoxyalkyl, aryl, or phenoxy group connecting to a substituted or unsubstituted heterocyclic ring having 1 to 25 carbon atoms and containing one or more hetero atoms such as nitrogen, oxygen, sulfur or combinations thereof; and the $R_4$, $R_5$ and $R_6$ may further combine with each other to form a 5-, 6- or 7-membered ring.

In general, the mercapto-triazoles, including the 1,2,4-triazolium compounds, are included in the electrolyte compositions in amounts of 0.5 mg/L to 200 mg/L, or such as from 10 mg/L to 150 mg/L, or such as from 50 mg/L to 100 mg/L. Such mercapto-triazoles are generally commercially available or may be prepared by methods well know in the art.

Alkaline materials also may be added to maintain the pH of the compositions from 7 to 14, or such as from 8 to 12, or such as from 9 to 11. Such alkaline materials include, but are not limited to, sulfates, carbonates, phosphates, hydrogen phosphates and other salts of sodium, potassium and magnesium. For example, $K_2CO_3$, $Na_2CO_3$, $Na_2SO_4$, $MgSO_4$, $K_2HPO_4$, $Na_2HPO_4$, $Na_3PO_4$ and mixtures thereof are suitable alkaline materials.

In addition to the alkaline materials described above, hypophosphite salts also may be included to maintain the pH ranges described above. Typically, the monohydrate salts are employed. Such hypophosphite salts include, but are not limited to, alkali metal hypophosphites such as sodium hypophosphite, potassium hypophosphite, lithium hypophosphite, rubidium hypophosphite, cesium hypophosphite, ammonium hypophosphite and mixtures thereof.

The alkaline materials used in the electrolyte compositions may be included in the compositions in amounts to maintain the pH of the compositions in the ranges described above. Generally, the alkaline materials are added to the compositions in amounts of 0.5 g/L to 25 g/L, or such as from 1 g/L to 20 g/L, or such as from 5 g/L to 15 g/L.

The electrolyte compositions also may include one or more surfactants. Any suitable surfactant may be used in the compositions. Such surfactants include, but are not limited to, alkali metal salts of alkyl sulfates, alkoxyalkyl sulfates (alkyl ether sulfates) and alkoxyalkyl phosphates (alkyl ether phosphates). The alkyl and alkoxy groups typically contain from 10 to 20 carbon atoms. Examples of such surfactants are sodium lauryl sulfate, sodium capryl sulfate, sodium myristyl sulfate, sodium ether sulfate of a $C_{12}$-$C_{18}$ straight chain alcohol, sodium lauryl ether phosphate and corresponding potassium salts.

Other suitable surfactants which may be used include, but are not limited to, N-oxide surfactants. Such N-oxide surfactants include, but are not limited to, cocodimethylamine N-oxide, lauryldimethylamine N-oxide, oleyldimethylamine N-oxide, dodecyldimethylamine N-oxide, octyldimethylamine N-oxide, bis-(hydroxyethyl)isodecyloxypropylamine N-oxide, decyldimethylamine N-oxide, cocamidopropyldimethylamine N-oxide, bis(hydroxyethyl) $C_{12}$-$C_{15}$ alkoxypropylamine N-oxide, lauramine N-oxide, laurami-dopropyldimethylamine N-oxide, $C_{14}$-$C_{16}$ alkyldimethylamine N-oxide, N,N-diemthyl (hydrogenated tallow alkyl) amine N-oxide, isostearamidopropyl morpholine N-oxide, and isostearamidopropyl pyridine N-oxide.

Other suitable surfactants include, but are not limited to, betaines, and alkoxylates such as the ethylene oxide/propylene oxide (EO/PO) compounds. Such surfactants are well known in the art.

Many of the surfactants may be commercially obtained or made by methods described in the literature. Typically, the surfactants are included in the compositions in amounts of 0.1 mL/L to 20 mL/L, or such as from 1 mL/L to 15 mL/L, or such as from 5 mL/L to 10 mL/L.

The electrolyte compositions also may include conventional additives to assist in the alloy deposition processes. Such additives are included in conventional amounts.

The components of the compositions may be combined by any suitable method known in the art. Typically, the components are mixed in any order and the compositions are brought to a desired volume by adding sufficient water. Some heating may be necessary to solubilize certain composition components.

The gold-silver-copper alloys may be deposited on substrates from the electrolyte compositions by any suitable deposition process. Such processes include, but are not limited to current manipulation methods such as interrupted current methods, pulse plating, pulse reverse plating, periodic reverse, DC plating, and combinations thereof. For example, one method of current manipulation involves using repeated cycles ranging from 1:4, i.e., 25 ms with current turned on followed by 100 ms with the current turned off, to 4:1, i.e., 100 ms with the current turned on followed by 25 ms with the current turned off. Another example is using repeated cycles of 1:5, i.e., 1 second with the current turned on followed by 5 seconds with the current turned off, to 5:1, i.e., 5 seconds with the current turned on followed by 1 second with the current turned off. Typically, the cycle is 1:2 to 8:1.

Any suitable current density which permits the deposition of a bright and color uniform gold-silver-copper alloy may be used. Typically, current densities used range from 0.05 ASD to 10 ASD, or such as from 0.1 ASD to 5 ASD, or such as 1 ASD to 3 ASD. Typically, the current density is 0.1 ASD to 4 ASD, more typically from 0.2 ASD to 2 ASD.

The compositions may be used to deposit a gold-silver-copper metal alloy on any suitable substrate. Such substrates may include, but are not limited to, non-conductive materials, such as conductive polymers, which have been made conductive by one or more methods known in the art, non-precious metal containing substrates such as iron containing substrates, copper and copper alloys, tin and tin alloys, lead and lead alloys, zinc and zinc alloys, nickel and nickel alloys, chromium and chromium alloys, aluminum and aluminum alloys, and cobalt and cobalt alloys. Examples of precious metals which may be deposited with gold-silver-copper alloys from the electrolyte compositions include gold, silver, platinum, palladium and their alloys.

Any suitable plating apparatus may be used to deposit the gold-silver-copper alloys on the substrates. Conventional electroplating apparatus may be employed. The substrates function as the cathodes and a soluble or insoluble electrode may function as the anode. Typically, an insoluble anode is used. Examples of insoluble anodes are platinum dioxide and ruthenium dioxide.

Plating times may vary. The amount of time depends on the desired thickness of the gold-silver-copper alloy on the substrate. Typically, the thickness of the alloy is from 0.5 microns to 25 microns, or such as from 2 microns to 20 microns, or such as from 5 microns to 10 microns.

The amount of gold in the alloy may range from 8 karats to 23 karats, or such as from 12 karats to 18 karats. Typically, the amount of gold in the gold-silver-copper alloy is 18 karats. A gold-silver-copper alloy of 18 karats and 2N corresponds to 75% gold, 16% silver and 9% copper. A gold-silver-copper alloy of 18 karats and 3N corresponds to 75% gold, 12.5% silver and 12.5% copper. The gold-silver-copper alloys deposited from the electrolyte compositions are free of haze.

EXAMPLE 1

An aqueous plating bath having the following composition is prepared:

| COMPONENT | AMOUNT |
|---|---|
| Di-sodium hydrogenphosphate | 10 g/L |
| Sodium hypophosphite monohydrate | 0.5 g/L |
| Copper cyanide | 40 g/L |
| Potassium silver cyanide | 255 mg/L |
| Potassium gold cyanide | 10 g/L |
| Potassium cyanide | 55 g/L |
| 2-methylimidazole-4(5)-dithiocarboxylic acid | 55 mg/L |
| 5-mercapto-1H-tetrazole-1-methane sulfonic acid | 55 mg/L |
| Lauryldimethylamine N-oxide | 0.70 mL/L |

The pH of the bath is 10 and the temperature is 60° C. The bath is agitated by a motorized circular insoluble gold anode and solution stirring. Brass and stainless steel coupons (cathodes) are electroplated in the above electrolyte bath at 0.4 ASD using a current interruption method of 5 seconds on and 1 second off. Electroplating continued for 30 minutes to provide brass and stainless steel coupons plated with 10 microns of gold-silver-copper alloy layers.

The alloy deposits expected are 18 karats with a 2N uniform color, i.e., bright yellow appearance. No haze is observable on the alloys.

EXAMPLE 2

An aqueous plating bath of the following formula is prepared:

| COMPONENT | AMOUNT |
|---|---|
| Di-sodium hydrogenphosphate | 15 g/L |
| Sodium hypophosphite monohydrate | 1 g/L |
| Copper cyanide | 40 g/L |
| Potassium silver cyanide | 240 mg/L |
| Potassium gold cyanide | 10 g/L |
| Potassium cyanide | 60 g/L |
| 4(5)-imidazole-dithiocarboxylic acid | 50 mg/L |

-continued

| COMPONENT | AMOUNT |
|---|---|
| 5-mercapto-1H-tetrazole-1-acetic acid | 50 mg/L |
| Sodium lauryl ether phosphate | 0.75 mL/L |

The pH of the bath is 9 at 65° C. The bath is agitated during electroplating by a motorized disc platinum dioxide insoluble electrode and solution stirring.

Brass coupons (cathodes) are plated with the formulation with a current interruption method where the current is one for 3 seconds and off for 1 second. Gold-silver-copper alloy deposition is done for 60 minutes at a current density of 0.5 ASD. A 20 microns layer of gold-silver-copper is deposited on each brass coupon.

The gold-silver-copper alloy layers are expected to be 18 karats and have a bright 2N uniform color, i.e., yellow. No haze is expected to be observable on the surfaces of the gold-silver-copper alloy layers.

EXAMPLE 3

An aqueous plating bath having the following formulation is prepared:

| COMPONENT | AMOUNT |
|---|---|
| Copper sulfate pentahydrate | 45 g/L |
| sodium gold sulfite | 12 g/L |
| Silver nitrate | 250 mg/L |
| Sodium sulfite | 50 g/L |
| 2-ethylimidazole-4(5)-dithiocarboxylic acid | 60 mg/L |
| 5-mercapto-1H-tetrazole-1-methane sulfonic acid | 45 mg/L |
| Sodium ether sulfate ($C_{12}$ straight chain alcohol) | 0.65 mL/L |

The above plating bath has a pH of 8 and is at 70° C. Brass coupons (cathodes) are placed in the bath and the bath is agitated with a platinum dioxide disc anode connected to a motor and solution stirring. The solution agitation continues throughout gold-silver-copper deposition.

The current density is 0.6 ASD. Current is applied for 60 ms and then turned off for 100 ms. This current interruption pattern is continued for 40 minutes to deposit a gold-silver-copper alloy on the brass coupons having a thickness of 10 microns.

The alloy deposit is expected to be 18 karats and have a bright yellow 3N uniform color. No haze on the surface of the alloy surfaces is expected.

EXAMPLE 4

An aqueous plating bath having the following formula is prepared:

| COMPONENT | AMOUNT |
|---|---|
| Di-potassium hydrogenphosphate | 10 g/L |
| Potassium hypophosphite monohydrate | 1 g/L |
| Copper cyanide | 35 g/L |
| Potassium gold cyanide | 15 g/L |
| Potassium silver cyanide | 230 mg/L |
| Potassium cyanide | 45 g/L |
| 4-methylimidazole-5-dithiocarboxylic acid | 65 mg/L |

-continued

| COMPONENT | AMOUNT |
|---|---|
| 5-mercapto-1H-tetrazole-1-acetic acid | 50 mg/L |
| Sodium ether sulfate ($C_{18}$ straight chain alcohol) | 0.8 mL/L |

The pH of the plating bath is 9 and the temperature of the bath is 70° C. The bath is agitated with a motorized circular insoluble anode composed of platinum dioxide and solution stirring. Steel coupons (cathodes) are placed in the bath and are plated with a gold-silver-copper alloy. The current density is 1 ASD. The current is applied for 0.5 seconds and is turned off for 1 second. This current interruption pattern is done for 60 minutes to form a gold-silver-copper alloy on each steel coupon.

The alloy deposits on each of the coupons are expected to be 18 karats with a 3N deep yellow haze-free appearance. The color on each coupon is expected to be both bright and uniform.

EXAMPLE 5 (COMPARATIVE)

An aqueous plating bath having the following formula is prepared:

| COMPONENTS | AMOUNTS |
|---|---|
| Di-sodium hydrogenphosphate | 15 g/L |
| Sodium hypophosphite monohydrate | 1 g/L |
| Copper cyanide | 30 g/L |
| Potassium silver cyanide | 185 mg/L |
| Potassium gold cyanide | 10 g/L |
| Potassium cyanide | 40 g/L |
| Ethylene-thiourea | 100 mg/L |
| Alkyl-dimethyl-amine oxide | 0.2 mL/L |

The pH of the formulation is 10 at 20° C. The formulation is agitated with a motorized circular insoluble platinum dioxide anode and solution stirring. The bath is raised to 70° C. and brass coupons (cathodes) are placed in the formulation to be plated with a gold-silver-copper alloy.

The current density is 1 ASD and a current interruption method is used. Current is applied for 0.3 seconds and turned off for 1 second. This pattern is repeated for 30 minutes. A 10 micron gold-silver-copper alloy is deposited on the coupons. The alloy is expected to be 18 karats and have a 2N color. However, the 2N color is not expected to be bright and uniform. It is expected to show an observable undesirable haze at a thickness of more than 5 microns.

What is claimed is:

1. A composition comprising one or more sources of gold ions, one or more sources of silver ions, one or more sources of copper ions, one or more compounds chosen from mercapto-tetrazoles, mercapto-triazoles and salts thereof, and one or more dithiocarboxylic acids having a non-protic carbon atom in alpha position to a dithiocarboxyl functionality, salts and esters thereof.

2. The composition of claim 1, wherein the one or more dithiocarboxylic acids having a non-protic carbon atom in the alpha position to the dithiocarboxyl functionality, salts and esters thereof ranges from 0.5 mg/L to 200 mg/L of the composition.

3. The composition of claim 1, further comprising one or more surfactants.

4. The composition of claim 1, further comprising one or more alkaline materials.

5. A composition consisting essentially of one or more sources of gold ions, one or more sources of silver ions, one or more sources of copper ions, one or more dithiocarboxylic acids having a non-protic carbon atom in alpha position to a dithiocarboxyl functionality, salts and esters thereof, one or more surfactants, one or more alkaline materials, and one or more compounds selected from the group consisting of mercapto-tetrazoles, mercapto-triazoles and salts thereof.

6. A method comprising:

a) providing a composition comprising one or more sources of gold ions, one or more sources of silver ions, one or more sources of copper ions, one or more dithiocarboxylic acids having a non-protic carbon atom in alpha position to the dithiocarboxyl functionality, salts and esters thereof, and one or more mercapto-tefrazoles, mercapto-triazoles and salts thereof;

b) immersing a substrate into the composition; and c) electroplating a gold-silver-copper alloy on the substrate.

7. The method of claim 6, wherein the gold-silver-copper alloy is deposited on the substrate by current interruption using repeating cycles of 1:2 to 8:1.

8. The method of claim 6, wherein a current density is 0.05 ASD to 10 ASD.

* * * * *